United States Patent [19]

Barkis et al.

[11] Patent Number: 4,557,958

[45] Date of Patent: Dec. 10, 1985

[54] NON-FRAYING, BREATHABLE FABRIC SUITABLE FOR USE AS A COTTON BALE COVER AND BAG FABRIC, APPARATUS AND METHOD FOR MAKING THE SAME

[75] Inventors: Edward D. Barkis, Marietta, Ga.; Douglas G. Moore, Wadley, Ala.; Allen M. Fernald, Douglasville; Felton L. McClellan, Nashville, both of Ga.

[73] Assignee: Standard Oil Company (Indiana), Chicago, Ill.

[21] Appl. No.: 627,359

[22] Filed: Jul. 3, 1984

[51] Int. Cl.[4] ..... B32B 3/00

[52] U.S. Cl. ..... 428/36; 156/244.11; 427/286; 427/288; 428/196; 428/226

[58] Field of Search ..... 428/55, 196, 226, 35, 428/36; 427/286, 288; 156/244.11

[56] References Cited

U.S. PATENT DOCUMENTS 4,180,606 12/1979 Hance et al. ..... 428/196

*Primary Examiner*—Marion C. McCamish

*Attorney, Agent, or Firm*—David E. Boone; William T. McClain; William H. Magidson

[57] ABSTRACT

Fabric suitable for use as a cotton bale cover or bag fabric comprising a woven substrate with a series of stripes of a thermoplastic resin fused thereto. This fabric permits sampling of cotton in a bale but prevents fraying of the fabric in this operation. Further, the fabric permits moisture to pass through the material stored therein. Apparatus and method for making the fabric are also shown.

15 Claims, 4 Drawing Figures

Figure 4:
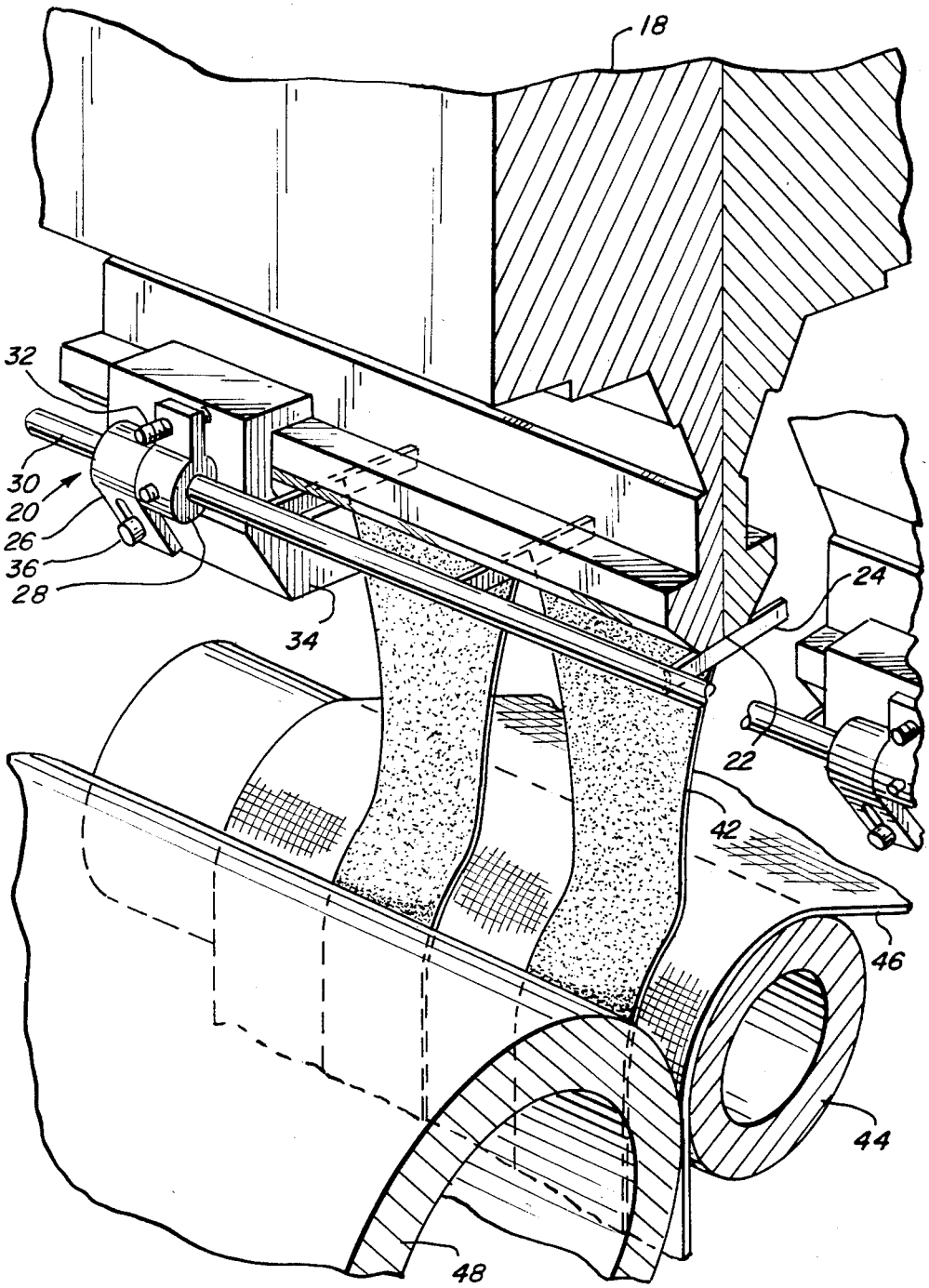

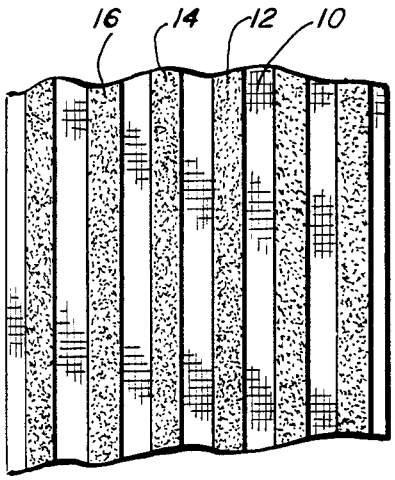
FIG. 1
FIG. 2
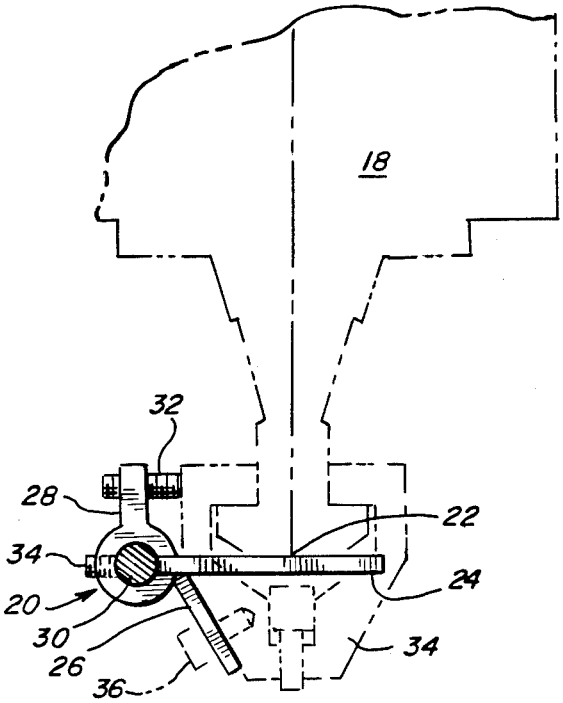
FIG. 3
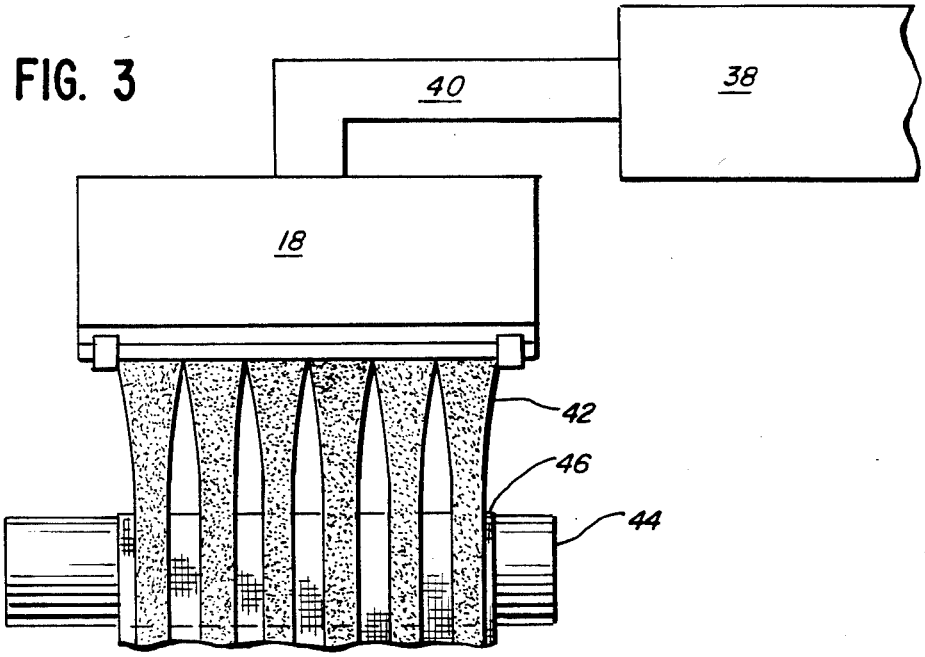

NON-FRAYING, BREATHABLE FABRIC SUITABLE FOR USE AS A COTTON BALE COVER AND BAG FABRIC, APPARATUS AND METHOD FOR MAKING THE SAME

BACKGROUND OF THE INVENTION

1. Field of Invention

This invention relates to a polyolefin woven fabric which may be coated in a particular manner to produce a fabric which does not fray when cold cut, but still permits air to pass through. The fabric is flexible enough to be spiral-tubed into cotton bale covers and made into bags with conventional apparatus.

2. Prior Art

Woven polyolefin fabrics are widely used in the production of bags and cotton bale covers. These fabrics will fray when cold cut and this fraying is a potential contamination source in cotton bales since these bale covers are cut for sampling purposes. The resulting frayed fabric has an unacceptable appearance. Extrusion coating of the full width of polyolefin fabrics will prevent fraying, but the products are too stiff and cannot be easily spiral tubed into cotton bale covers. Additionally, in both the bagging of cotton and feed grains, moisture cannot pass through the cotton or away from the grain. This will result in mildewing and mold formation.

OBJECTS OF THE INVENTION

An object of this information is to provide a new type of fabric especially suitable for the production of cotton bale covers and bag fabrics.

A further object is to provide a method of producing such fabrics.

A further object is to provide apparatus for carrying out the method.

Other objects and advantages of the invention will be apparent to one skilled in the art upon reading this disclosure.

SUMMARY OF THE INVENTION

This invention describes a fabric suitable for use as a cotton bale cover or bag fabric comprising a woven substrate with a series of stripes of a thermoplastic resin fused thereto, said stripes preventing fraying of said substrate when said fabric is cut.

Another object of the invention resides in a method of coating a substrate with stripes of a thermoplastic resins comprising extruding said resin through a die wherein a film or sheet of resin is extruded in molten form, cutting said sheet into a plurality of stripes, contacting said stripes with said substrate while said stripes are still molten under pressure to bond said stripes to said substrate.

In a further aspect of the invention, we provide apparatus for making a stripe coated substrate comprising an extruder, a film coating die on said extruder, a striping deckle provided with a plurality of fingers, a rubber nip roll, a chill roll, said nip and chill roll being positioned so as to form a nip therebetween, means to position adjustably the relative position of said die and said nip to permit material extruded from said die to be deposited on said nip roll upstream of said nip.

THE DRAWING

Accompanying and forming a part of this disclosure is a drawing comprising:

FIG. 1, a drawing of the fabric of this invention;

FIG. 2, a cross-section view through the die of the extruder with the stripe forming deckle in place;

FIG. 3, a plain view showing the extrusion of resin onto the chill roll; and FIG. 4, a perspective view of a portion of the apparatus of this invention partly in section.

PREFERRED EMBODIMENTS OF THE INVENTION

The substrate woven fabric used in the product of this invention can be of any structure but plain weave tape yarn fabrics will be generally used for reasons of economy. These can be made with any of the known fabric constructions. One suitable fabric contains 12 warp ends per inch with 8 fill or weft yarns per inch. The resins used for the fabric are generally polypropylene and polyethylene such as high density polyethylene and linear low density polyethylene.

The coating stripe can be any resin which can be extrustion coated onto the substrate. These can be polyethylene and propropylene but frequently used are blends of these resins and blends of either of these resins with other copolymers. For instance, one suitable striping resin is a blend of polypropylene homopolymer with ethylene-methyl acrylate copolymer. The coating can be less than a mil thick to a few mils thick to provide the advantage of this invention. A range of 0.5 to 3 mils is satisfactory. The fabric of this invention can be easily handled in conventional spiral tubers and bag making machines.

Illustrative combinations will be found in the examples.

APPARATUS

Now, directing attention to the drawing, the invention will be more fully described.

FIG. 1 shows a portion of a piece of the fabric with the stripes thereon. Wide variation is possible in the width of the stripes and the spacing between them. While not wishing to be unduly limiting, suitable fabrics can be made with stripes approximately ½" wide with a spacing of ¾" up to stripes 3" wide with a 3" gap therebetween. We believe that a 2½" stripe with a 2" gap would be most suitable for cotton bale covers. In FIG. 1, the woven fabric substrate 10 is clearly seen. A plurality of stripes 12, 14, and 16, are shown thereon.

FIGS. 2, 3, and 4 should be considered together since they illustrate the same apparatus with varying detail for certain parts. Common reference numerals are used throughout these drawings with specific features being shown in each of them.

Next considering FIG. 2, a cross-section view of the die 18 and the deckle 20 is shown with the deckle in place. The die terminates as a slot at point 22 against which the fingers 24 rest. The deckle 20 includes a mounting hinge 26 and a pressure arm 28 both of which are mounted upon shaft 30 of deckle 20. Screw 32 is provided to apply pressure against shaft 30 carrying fingers 24 so that fingers 24 are in tight contact with the die orifice 22. The deckle 20 is mounted upon support 34 and held in place by set screw 36 passing through hinge 26.

Now referring to FIG. 3, a plan view of the system is shown including extruder 38 connected by adapter 40 to die 18. The extruded plastic 42 is shown after being cut by fingers 24 into stripes extending from the die. This shows the characteristic necking down of the resin as it is pulled from the die. Nip roll 44 (rubber covered) is shown with fabric passing thereover onto which fabric the stripes 42 are extruded.

FIG. 4 shows the same features which have been shown in FIGS. 2 and 3 but in perspective to provide a better understanding of the invention. One additional apparatus element shown here is metal nip roll 48. Nip pressure can range from 20 to 80 psig.

Suitable fabric feed and take-up systems can be easily supplied by those skilled in the art.

When it is desired to clean the apparatus or to shift to full extrusion coating of a fabric substrate, the deckle 20 can be removed by removing said screws 36 and sliding the deckle to one side of the machine where it can be removed.

The control of the width of the stripe is carried out by varying the position of the extrusion die with respect to the fabric passing thereunder. In the system shown with an Egan extruder, it is possible to move the extruder and die 18 vertically and horizontally. Thus, the positioning of the stripe as it contacts the fabric 46 can be varied as well as the length of travel of the strip 42 on fabric 46 as it passes around nip roll 44. In the work reported in the examples, the die orifice was approximately positioned so that the distance between the die orifice and roll 44 was approximately 1½" and the coated fabric traveled on the roll 44 a short distance before entering the nip between the nip roll and the chill roll.

The following examples illustrates specific embodiments of the invention. These should not be considered unduly limiting.

EXAMPLE I

In this example, a plain weave 12 by 8 polypropylene tape yarn woven fabric was coated with stripes approximately 2½" wide with a 2" gap between the stripes. The extrusion coater was an Egan No. 1 machine with a die zone temperature regulated between 500° F. and 575° F. The coating composition was a blend of 70 weight percent 35 melt flow polypropylene homopolymer having a density of 0.905 grams per cc and 30 percent of an ethylene-methyl acrylate copolymer having a melt index of 2.4 and a density of 0.945 grams per cc. The methyl acrylate content of the copolymer was approximately 20 weight percent. A coated fabric which resisted fraying upon cutting was obtained. The copolymer striping resin contained 5 weight percent of UV-80 which is a hindered amine stabilizer. The 5 percent additive was a 10 percent stabilizer concentrate in a polypropylene carrier. The nip pressure was 54 psig. Line speed was 200 feet per minute.

EXAMPLE II

Similar results are obtained on the same polypropylene woven tape fabric using, as a striping resin, a composition containing 66.5 weight percent of 35 melt flow polypropylene homopolymer having a density of 0.905 grams per cc blended with 28.5 weight percent of a low density polyethylene having a 6.5 melt index and a density of 0.915 grams per cc. Five percent of the UV-80 used in Example I was also used. A good striped fabric which resisted fraying upon cutting is obtained using this system.

EXAMPLE III

A composition suitable for applying striped bands to high density polyethylene or linear low density polyethylene woven tape fabric can be prepared using low density polyethylene as the primary coating resin. The recipe would be 92.5 weight percent low density polyethylene, and 2.5 weight percent of a 10 percent of Ferro AM340 in a low density polyethylene carrier and 5 weight percent of a 10 percent concentrate of the UV-80 in a low density polyethylene low carrier. The fabric resists fraying upon cutting.

We claim:

1. A fabric suitable for use as a cotton bale cover or bag fabric comprising a woven polyolefin substrate with a series of stripes of a thermoplastic resin fused thereto, said stripes preventing fraying of said substrate when said fabric is cut.

2. The fabric of claim 1 wherein said substrate is woven from polyethylene or polypropylene tape yarn and said stripes are selected from polymeric material bondable thereto.

3. The fabric of claim 2 in the form of a spiral tube.

4. The fabric of claim 1 wherein said substrate is woven from polypropylene tape yarn and said stripes are a blend of polypropylene and ethylene-methyl acrylate copolymer.

5. The fabric of claim 1 wherein said substrate is woven from polypropylene tape yarn and said stripes are a blend of polypropylene and polyethylene.

6. The fabric of claim 1 wherein said substrate is woven from polyethylene tape yarn and said stripes are polyethylene.

7. A cotton bale covered with the fabric of claim 1.

8. A method of coating a woven polyolefin substrate with stripes of a thermoplastic resin comprising extruding said resin through a film coating die wherein a sheet of resin is extruded in molten form, cutting said sheet into a plurality of stripes, contacting said stripes with said substrate while said stripes are still molten under pressure to bond said stripes to said substrate.

9. The method of claim 8 wherein said substrate is woven from polyethylene or polypropylene tape yarns and said stripes are selected from polymeric materials bondable thereto.

10. The fabric of claim 8 wherein said substrate is woven from polypropylene tape yarn and said stripes are a blend of polypropylene and ethylene-methyl acrylate copolymer.

11. Apparatus for making a stripe coated substrate comprising an extruder, a film die on said extruder, a striping deckle removably mounted on said die, said deckle provided with a plurality of fingers which contact the die orifice when said deckle is in place, a rubber nip roll and a chill roll, said nip roll and chill roll being so positioned as to form a nip therebetween, said nip roll and said chill roll located to receive in said nip film extruded from said die, a means to position adjustably the relative position of said die and said nip to permit material extruded from said die to be deposited on material on said nip roll upstream of said nip.

12. The apparatus of claim 11 including means to pass substrate to said nip roll and through said nip.

13. A cotton bale covered with a fabric comprising a substrate woven from a polyolefin yarn, said substrate having a series of stripes of a thermoplastic resin fused thereto.

14. The cotton bale of claim 13 wherein said fabric is in the form of a spiral tube.

15. The cotton bale of claim 13 wherein said polyolefin yarn is selected from the group consisting of a polyethylene tape yarn and a polypropylene tape yarn.

* * * * *

US004557958B1

REEXAMINATION CERTIFICATE (1745th)

United States Patent [19]

Barkis et al.

[11] B1 4,557,958

[45] Certificate Issued Jul. 14, 1992

[54] NON-FRAYING, BREATHABLE FABRIC SUITABLE FOR USE AS A COTTON BALE COVER AND BAG FABRIC, APPARATUS AND METHOD FOR MAKING THE SAME

[75] Inventors: Edward D. Barkis, Marietta, Ga.; Douglas G. Moore, Wadley, Ala.; Allen M. Fernald, Douglasville; Felton L. McClellan, Nashville, both of Ga.

[73] Assignee: Standard Oil Company (Indiana), Chicago, Ill.

Reexamination Request:
No. 90/001,204, Mar. 25, 1987
No. 90/001,833, Aug. 28, 1989

Reexamination Certificate for:

| | |
|---|---|
| Patent No.: | **4,557,958** |
| Issued: | **Dec. 10, 1985** |
| Appl. No.: | **627,359** |
| Filed: | **Jul. 3, 1984** |

[51] Int. Cl.[5] ..... B32B 3/00

[52] U.S. Cl. ..... 206/83.5; 156/244.11; 383/117; 383/127; 427/286; 427/288; 428/35.2; 428/36.1; 428/196; 428/226

[58] Field of Search ..... 428/36, 196, 226; 156/244.11; 427/286, 287

[56] References Cited

U.S. PATENT DOCUMENTS

| | | | |
|---|---|---|---|
| 2,798,820 | 7/1957 | Nelson | 117/11 |
| 3,110,905 | 11/1963 | Rhodes | 139/391 |
| 3,350,372 | 10/1967 | Anspon et al. . | |
| 3,356,556 | 12/1967 | Violette et al. | 156/244 |
| 3,418,396 | 12/1968 | Edwards et al. | 156/244 |
| 3,503,106 | 3/1970 | Port et al. | 28/72 |
| 3,521,747 | 7/1970 | Katz | 206/53 |
| 3,595,722 | 4/1971 | Dawbarn | 156/177 |
| 3,616,099 | 10/1971 | Shanok et al. | 161/5 |
| 3,734,812 | 5/1973 | Yazawa | 161/57 |
| 3,797,987 | 3/1974 | Marion | 425/463 |
| 3,801,417 | 4/1974 | Shanok et al. | 161/43 |
| 3,871,910 | 3/1975 | Barkis et al. | 117/138.8 E |
| 3,900,625 | 8/1975 | Chen | 428/110 |
| 3,951,050 | 4/1976 | Poole | 93/35 R |
| 3,970,503 | 7/1976 | Yoshimura | 156/323 |
| 4,039,364 | 8/1977 | Rasmussen | 156/164 |
| 4,123,489 | 10/1978 | Kelley | 264/141 |
| 4,144,111 | 3/1979 | Schaerer | 156/187 |
| 4,145,467 | 3/1979 | Malik | 428/91 |
| 4,188,445 | 2/1980 | Hill | 428/246 |
| 4,192,127 | 3/1980 | O'Neil et al. | 57/7 |
| 4,228,641 | 10/1980 | O'Neil | 57/234 |
| 4,255,323 | 3/1981 | Barkis et al. | 260/45.75 N |
| 4,264,659 | 4/1981 | Pattenden | 428/35 |
| 4,288,482 | 9/1981 | Beck | 428/92 |
| 4,288,483 | 9/1981 | Miska et al. | 428/92 |
| 4,291,082 | 9/1981 | Stall | 428/138 |
| 4,368,233 | 1/1983 | Barkis et al. | 428/245 |
| 4,406,724 | 9/1983 | Bostian et al. | 156/161 |
| 4,433,536 | 2/1984 | O'Neil | 57/233 |
| 4,501,631 | 2/1985 | Bostian et al. | 156/161 |

FOREIGN PATENT DOCUMENTS

| | | |
|---|---|---|
| 843259 | 6/1970 | Canada . |
| 1072211 | 2/1980 | Canada . |
| 1521502 | 8/1978 | United Kingdom . |

OTHER PUBLICATIONS

1982 Specifications for Cotton Bale Packaging Materials—Joint Cotton Industry Bale Packaging Committee, May 1982, National Cotton Council of Amer.

Federal Register, vol. 47, No. 127, p. 28606, Thursday, Jul. 1, 1982.

Egan Machinery—Extrusion Coating, 1976, pp. 1-23.

"Machinery Developments Jog Ahead", Paper, Film and Foil Converter, Feb. 1969, Bunte and Thornton.

"Technology and Materials Make News in Flexible Packaging", Miller, Plastics Technology, Jan. 1971, pp. 35-37.

Letter, National Cotton Council of America, Jun. 15, 1983; Doyle K. Needham.

A/S Platon Plastics Datasheet for FILMTEX® DX, (May 1976).

M. L. Cooper, et al., "The Coating of Woven Polypropylene Fabric," Journal of Coated Fibrous Materials, vol. 2 (Jul. 1972) pp. 36-47.

G. Baker, "Ethylene-Methyl Acrylate," Modern Plastics Encyclopedia, vol. 59, No. 10A (Oct. 1982) p. 81.

Eastman Plastics Materials Bulletin for TENITE® Polypropylene, Publication No. MB-31F, (Aug. 1981).

*Primary Examiner*—George F. Lesmes

[57] ABSTRACT

Fabric suitable for use as a cotton bale cover or bag fabric comprising a woven substrate with a series of stripes of a thermoplastic resin fused thereto. This fabric permits sampling of cotton in a bale but prevents fraying of the fabric in this operation. Further, the fabric permits moisture to pass through the material stored therein. Apparatus and method for making the fabric are also shown.

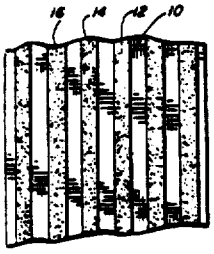

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-15 are cancelled.

* * * * *